US007669949B2

(12) United States Patent
Seto

(10) Patent No.: US 7,669,949 B2
(45) Date of Patent: Mar. 2, 2010

(54) LIQUID DROPLET EJECTING APPARATUS

(75) Inventor: Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 144 days.

(21) Appl. No.: 12/050,392

(22) Filed: Mar. 18, 2008

(65) Prior Publication Data

US 2009/0066738 A1 Mar. 12, 2009

(30) Foreign Application Priority Data

Sep. 12, 2007 (JP) ..... 2007-236640

(51) Int. Cl.
*B41J 29/38* (2006.01)

(52) U.S. Cl. ..... 347/10; 347/68

(58) Field of Classification Search ..... 347/10, 347/68

See application file for complete search history.

(56) References Cited

U.S. PATENT DOCUMENTS 6,582,043 B2 * 6/2003 Ishizaki ..... 347/12
2004/0066425 A1 * 4/2004 Togashi et al. ..... 347/9

FOREIGN PATENT DOCUMENTS

JP 2003-319669 11/2003
JP 2006-321200 11/2006

* cited by examiner

*Primary Examiner*—Matthew Luu
*Assistant Examiner*—Brian J Goldberg
(74) *Attorney, Agent, or Firm*—Fildes & Outland, P.C.

(57) ABSTRACT

A liquid droplet ejecting apparatus includes: a piezoelectric body that deforms and ejects liquid droplets as a result of a voltage being applied thereto and, when a superposed voltage, obtained by superposing a constant voltage of a constant voltage level and a waveform voltage of a sinusoidal waveform is applied thereto, an electrostatic capacitance and a deformation amount changes in response to the voltage level of the constant voltage; and a voltage applying unit that uses, as a reference voltage level, a voltage level of the constant voltage when the square of the deformation amount divided by the electrostatic capacitance is at a maximum value, and which applies to the piezoelectric body, when the piezoelectric body is to eject the liquid droplets, a drive voltage in which a drive waveform is superposed on the constant voltage that is within a predetermined range that includes the reference voltage level.

10 Claims, 15 Drawing Sheets

LIQUID DROPLET EJECTING APPARATUS

CROSS-REFERENCE TO RELATED APPLICATION

This application is based on and claims priority under 35 USC 119 from Japanese Patent Application No. 2007-236640 filed Sep. 12, 2007.

BACKGROUND

1. Technical Field

This invention relates to a liquid droplet ejecting apparatus and a liquid droplet ejecting method.

2. Related Art

Conventionally, liquid droplet ejecting apparatus such as inkjet printers that eject an ink liquid from ejection openings, with respect to a recording medium, to form an image have been known.

Among this type of liquid droplet ejecting apparatus, there is a liquid droplet ejecting apparatus that ejects ink by applying, with respect to a piezoelectric body such as a piezo element, for example, a drive voltage where a voltage of a predetermined drive waveform is superposed on a constant voltage (bias voltage) of a constant voltage level from a drive circuit to cause the piezoelectric body to deform and generate a volume change in a pressure generating chamber filled with an ink liquid.

Incidentally, among these piezoelectric bodies, there is a piezoelectric body whose deformation amount and electrostatic capacitance change depending on the voltage level of the bias voltage.

SUMMARY

According to an aspect of the invention, there is provided a liquid droplet ejecting apparatus including: a piezoelectric body that deforms and ejects liquid droplets as a result of a voltage being applied to the piezoelectric body and, when a superposed voltage, obtained by superposing a constant voltage of a constant voltage level and a waveform voltage of a sinusoidal waveform, is applied to the piezoelectric body, at least one of an electrostatic capacitance and a deformation amount of the piezoelectric body changes in response to the voltage level of the constant voltage; and a voltage applying unit that uses, as a reference voltage level, the voltage level of the constant voltage when the square of the deformation amount of the piezoelectric body divided by the electrostatic capacitance is at a maximum value, and that applies to the piezoelectric body, when the piezoelectric body ejects the liquid droplets, a drive voltage obtained by superposing a voltage of a predetermined drive waveform on the constant voltage that is within a predetermined range that includes the reference voltage level.

BRIEF DESCRIPTION OF THE DRAWINGS

Exemplary embodiments of the present invention will be described in detail based on the following figures, wherein.

DETAILED DESCRIPTION

Below, an exemplary embodiment of the present invention will be described in detail with reference to the drawings. It will be noted that, below, a case will be described where the present invention is applied to an inkjet printer.

Figure 1:
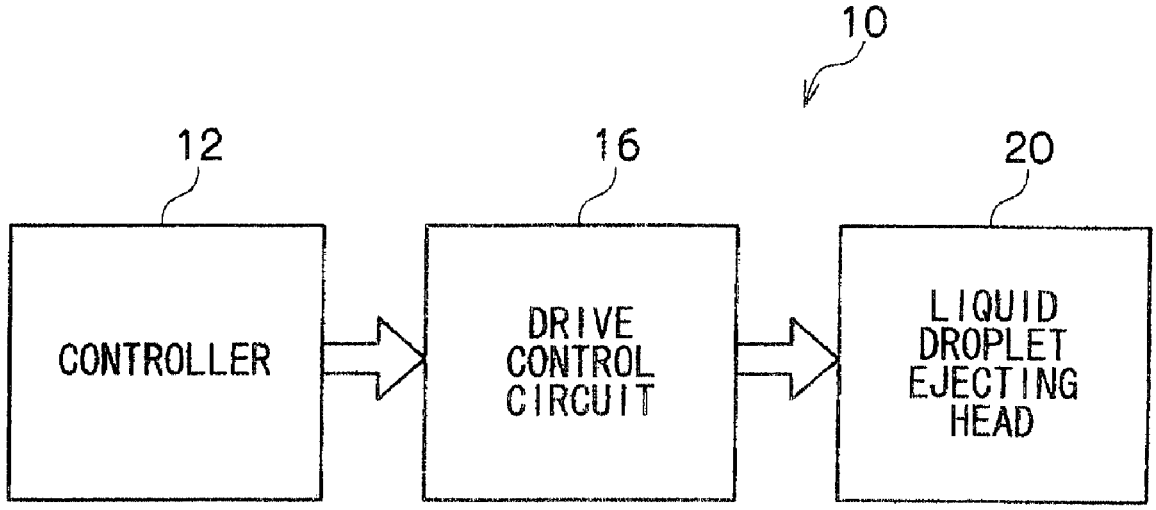
FIG. 1 is a block diagram showing the configuration of a printer according to an exemplary embodiment.

FIG. 1 shows the configuration of an inkjet printer 10 (below, simply called "printer") according to the present exemplary embodiment.

As shown in FIG. 1, the printer 10 includes a controller 12, a drive control circuit 16, and a liquid droplet ejecting head 20 having plural nozzles. The controller 12 controls operation of the entire printer 10. The drive control circuit 16 generates a drive voltage of a predetermined drive waveform and drives the liquid droplet ejecting head 20 (described later).

The controller 12 includes a CPU, a RAM and a ROM (not shown), and when image data are inputted from an external device (not shown), the controller 12 performs various types of image processing such as halftone processing with respect to the image data and creates dot data per dot configuring pixels. The controller 12 sequentially outputs, to the drive control circuit 16, control signals of plural lines in which is designated ejection/non-ejection of liquid droplets from the nozzles of the liquid droplet ejecting head 20 on the basis of the dot data that have been created.

Figure 2:
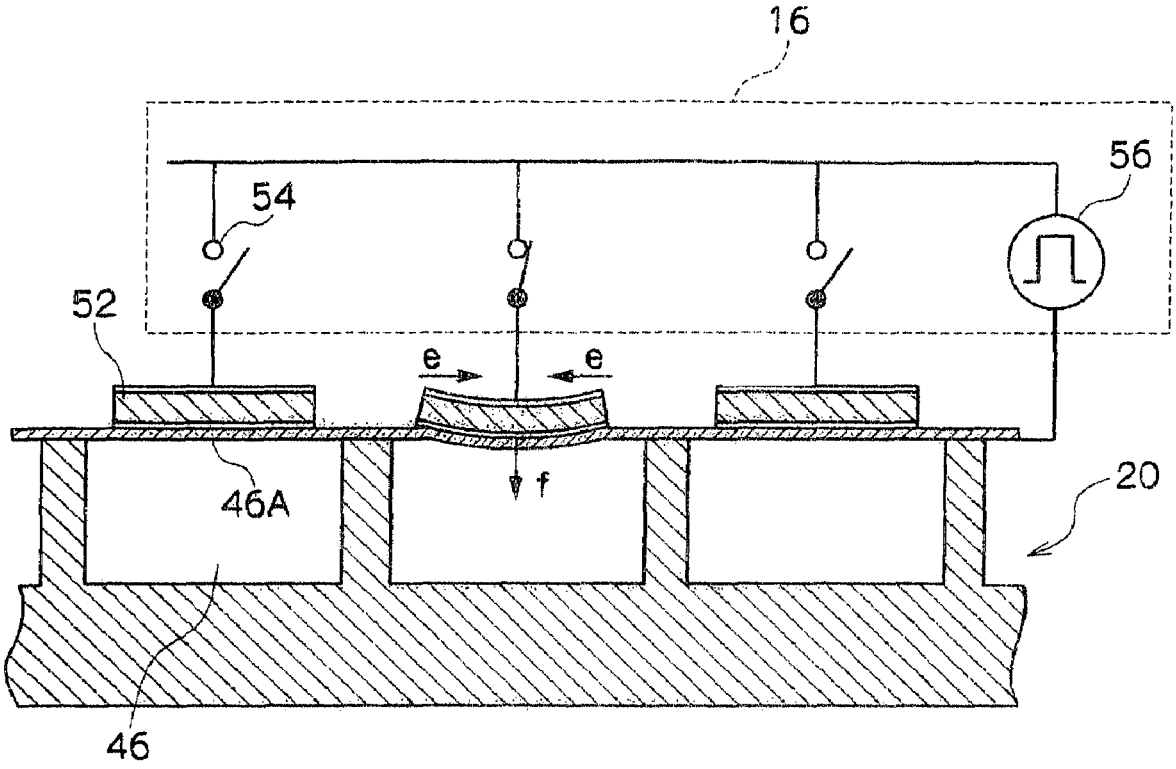
FIG. 2 is a diagram showings the general configuration of a drive control circuit and a liquid droplet ejecting head according to an exemplary embodiment.

FIG. 2 shows the general configuration of the drive control circuit 16 and the liquid droplet ejecting head 20 according to the present exemplary embodiment.

As shown in FIG. 2, the liquid droplet ejecting head 20 includes plural pressure chambers 46 and plural piezoelectric bodies 52.

An appropriate amount of ink is supplied from an ink cartridge (not shown) to the pressure chambers 46, and the ink is temporarily stored in the pressure chambers 46. Further, each of the pressure chambers 46 is individually connected to the outside via a nozzle (not shown).

Part of the wall surface of each of the pressure chambers 46 is configured as a diaphragm 46A, and the piezoelectric bodies 52 are attached to the diaphragm 46A.

The drive control circuit 16 is electrically connected by individual wires to each of the piezoelectric bodies 52 respectively included in each of the nozzles of the liquid droplet ejecting head 20. Further, the drive control circuit 16 includes switch circuits 54 that individually controls the ON/OFF of electrical power per wire. Further, the drive control circuit 16 includes a drive voltage generating circuit 56 that generates a drive voltage of a predetermined drive waveform. The drive control circuit 16 switches each of the switch circuits 54 ON/OFF in response to the control signals of plural lines inputted from the controller 12. Thus, the drive control circuit 16 controls the application of the generated drive voltage to the piezoelectric bodies 52.

The piezoelectric bodies 52 deform as a result of the drive voltage supplied from the drive control circuit 16 being applied thereto, whereby the pushing force with which the piezoelectric bodies 52 push against the diaphragm 46A is changed and the piezoelectric bodies 52 cause a volume change inside the pressure chambers 46. The ink stored inside the pressure chambers 46 is ejected from the nozzles of the liquid droplet ejecting head 20 by vibrational waves (pressure waves) in the ink generated by the volume change inside the pressure chambers 46.

In the present exemplary embodiment, the piezoelectric bodies 52 are configured by a relaxer material whose main component is lead zirconate titanate. Here, "main component" means to include a content of 70% or more. In the piezoelectric bodies 52 configured in this manner, when a superposed voltage, where a bias voltage of a constant voltage level and a waveform voltage of a sinusoidal waveform are superposed, is applied, at least one of an electrostatic capacitance and a deformation amount of the piezoelectric bodies 52 changes in response to the voltage level of the bias voltage.

Figure 3:
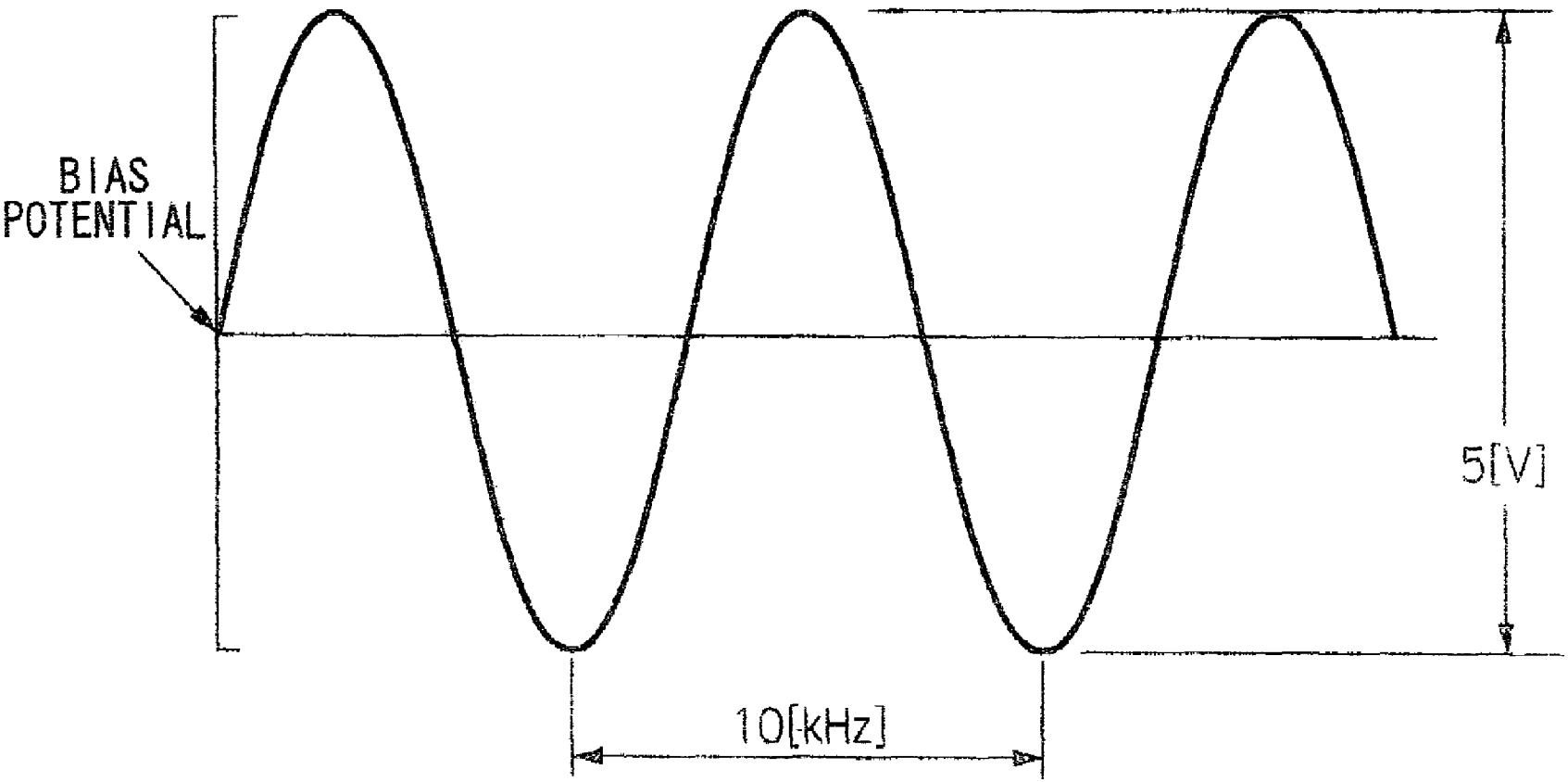
FIG. 3 is a waveform diagram showing an example of a voltage waveform applied when measuring the deformation amount of a piezoelectric body.
Figure 4:
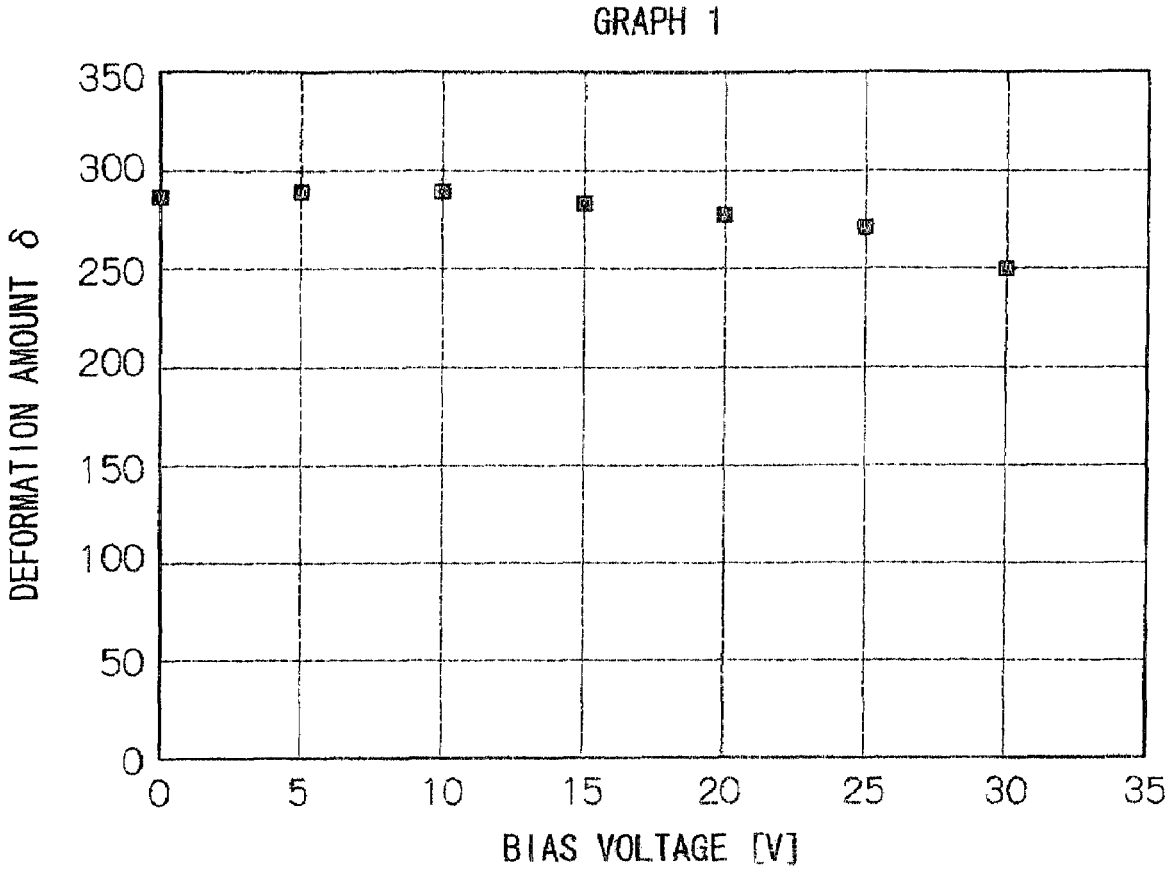
FIG. 4 is a graph showing changes in the deformation amount of the piezoelectric body per bias voltage according to an exemplary embodiment.

FIG. 3 shows a superposed voltage where, for example, a bias voltage of a constant voltage level and a waveform voltage of a sinusoidal waveform of 10 kHz and whose peak-to-peak voltage is 5 V are superposed. FIG. 4 shows an example of the relationship between the bias voltage and a measured deformation amount δ of the piezoelectric bodies 52, when this superposed voltage is applied to the piezoelectric bodies 52 while changing the bias voltage. It will be noted that this deformation amount δ can be determined by using a laser Doppler vibrometer, for example, to measure the movement of the diaphragm inside the pressure chambers.

As shown in FIG. 4, the deformation amount δ changes as in Graph 1 in response to the bias voltage.

In Japanese Patent Application Laid-Open (JP-A) No. 2006-321200, the highest voltage level in Graph 1 shown in FIG. 4 is used as the bias voltage.

Figure 5:
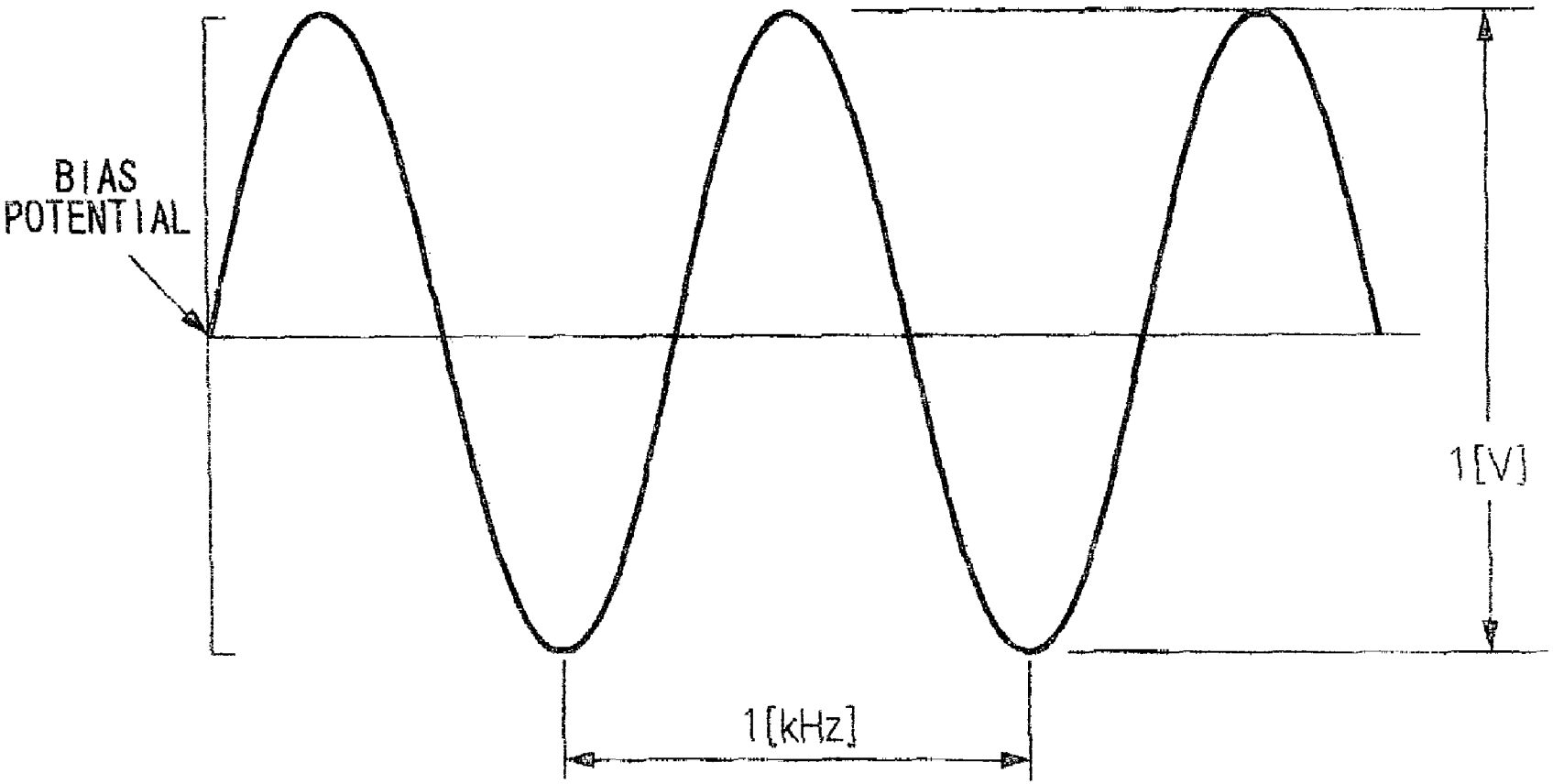
FIG. 5 is a waveform diagram showing an example of a voltage waveform applied when measuring the electrostatic capacitance of the piezoelectric body.
Figure 6:
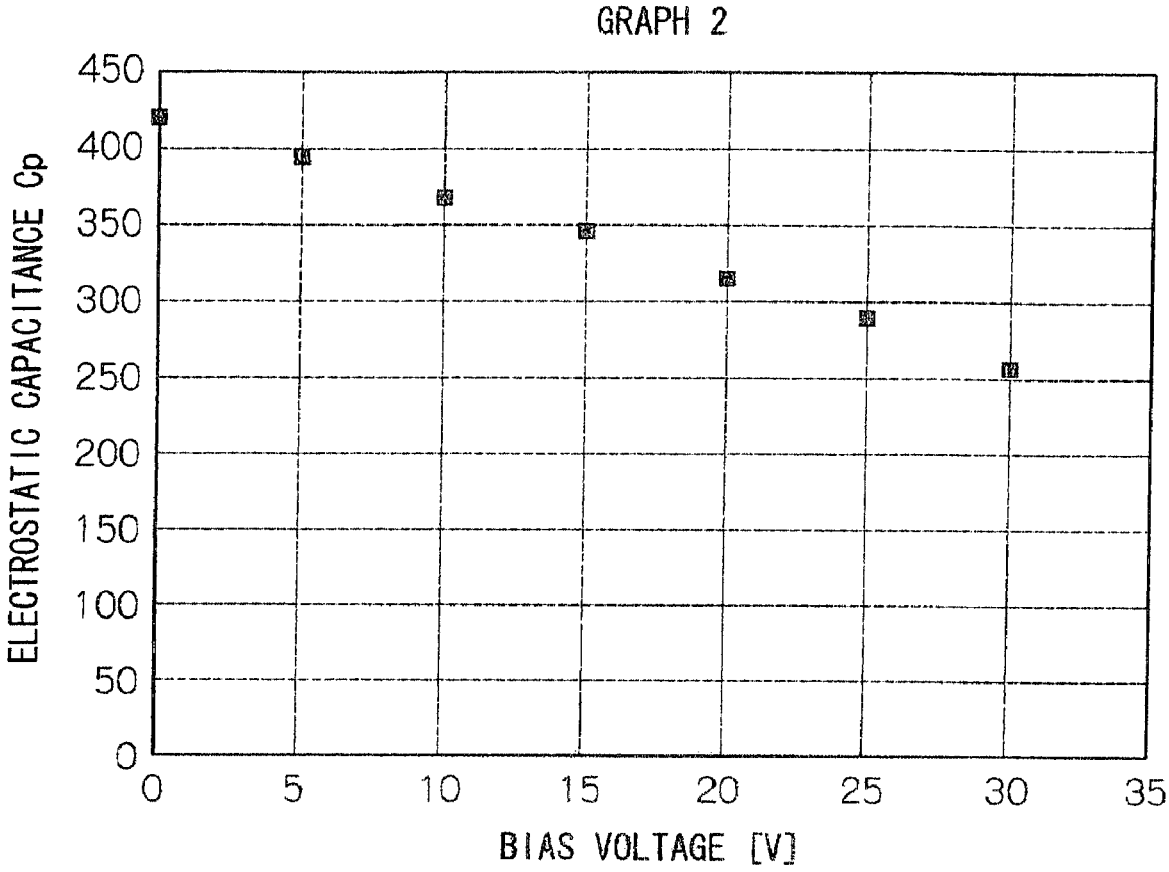
FIG. 6 is a graph showing changes in the electrostatic capacitance of the piezoelectric body per bias voltage according to an exemplary embodiment.

On the other hand, for example, FIG. 5 shows a superposed voltage, where a bias voltage of a constant voltage level and a waveform voltage of a sinusoidal waveform of 1 kHz and whose peak-to-peak voltage is 1 V are superposed. FIG. 6 shows an example of the relationship between the bias voltage and a measured electrostatic capacitance $C_p$ of the piezoelectric bodies 52, when this superposed voltage is applied to the piezoelectric bodies 52 while changing the bias voltage.

As shown in FIG. 6, the electrostatic capacitance $C_p$ changes as in Graph 2 in response to the bias voltage.

Here, the relationship between the excluded volume ΔQ inside the pressure chambers 46 resulting from deformation of the piezoelectric bodies 52 when applying a drive voltage to the piezoelectric bodies 52 and electrical energy J for driving the piezoelectric bodies 52 can be expressed as shown in expression (1) below.

$$J = \frac{30^2 \Delta Q^2}{(1-\upsilon^2)} \cdot \frac{\varepsilon\varepsilon_0}{d_{31}^2} \cdot \frac{t^2 t_p}{w^5 l} \tag{1}$$

ϵ: relative permittivity of piezoelectric body $\epsilon_o$: vacuum permittivity t: thickness of piezoelectric body and diaphragm $t_p$: thickness of piezoelectric body v: Poisson ratio of diaphragm $d_{31}$: piezoelectric constant (transverse effect)

w: width of diaphragm l: length of diaphragm

Below, the derivation of expression (1) will be described.

Figure 7:
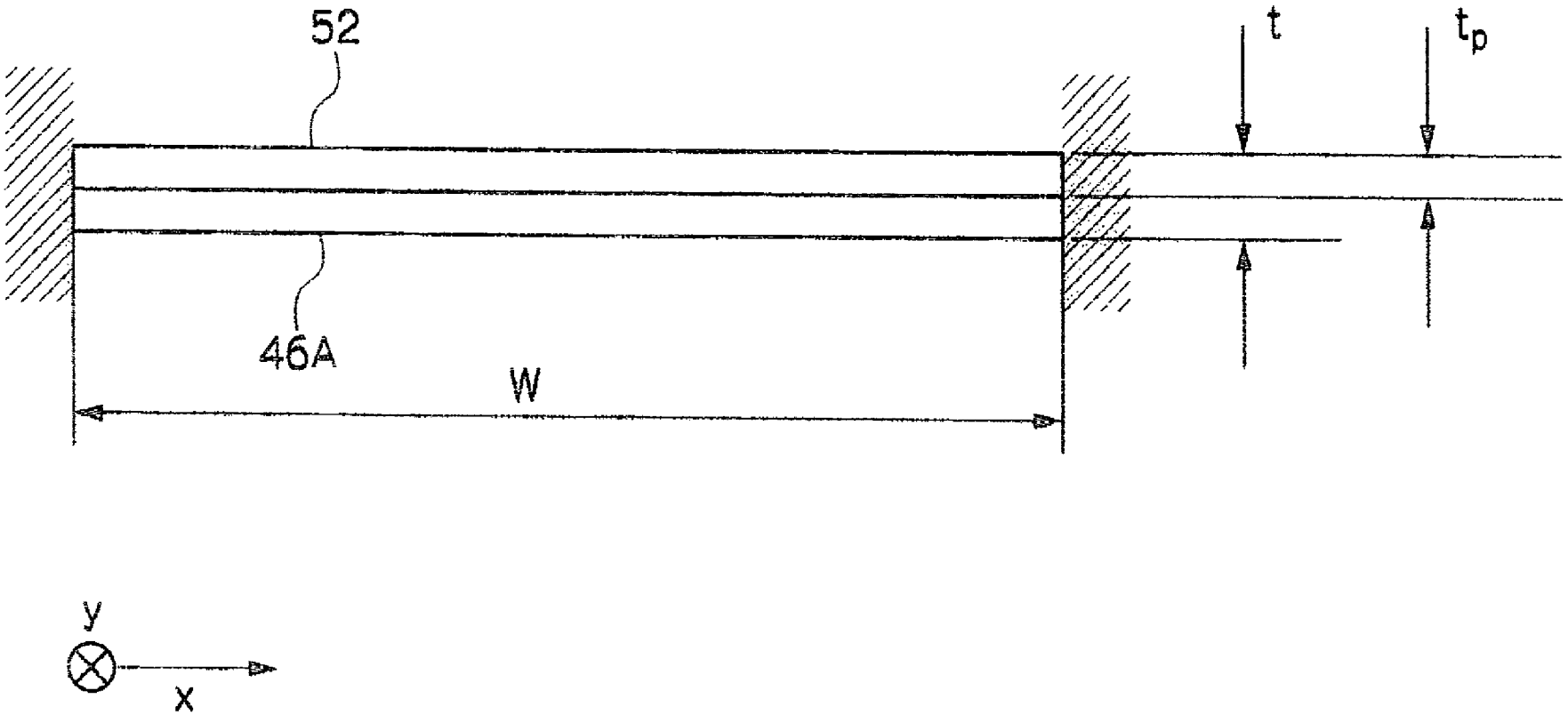
FIG. 7 is a diagram where the piezoelectric body according to an exemplary embodiment is modeled as a two-dimensional model.

When the width w of the diaphragm 46A is sufficiently small with respect to the length 1 (W<<l: plane stress condition), the piezoelectric bodies 52 can be replaced by a simple two-dimensional model where a both ends fixed beam receive equal weight such as shown in FIG. 7. It will be noted that the distance in the direction traversing the figure (x direction) of FIG. 7 is the width w of the piezoelectric body 52 and the distance in the direction orthogonal to the figure (y direction) is the length l of the piezoelectric body 52.

The deflection δ of the beam in this model can be expressed as shown in expression (2) below.

$$\delta = \frac{p(1-\upsilon^2)x^2}{2Et^3} \times (w-x)^2 \tag{2}$$

Thus, the volume change amount ΔQ of the pressure chamber 46 can be expressed as shown in expression (3) below.

$$\Delta Q = \int_0^l \int_0^w \delta dx dy \tag{3}$$

When expression (1) and a cross-sectional two-dimension model I are assigned to this expression (3), it can be expressed as shown in expression (4) below.

$$\Delta Q = \frac{(1-\upsilon^2)w^5 l}{60Et^3} p \tag{4}$$

E: Young's modulus of diaphragm p: uniformly-distributed weight

Next, the uniformly-distributed weight p in this expression (4) will be described. The bending moment M of the fixed end portions of the both ends fixed beam can be expressed as shown in expression (5) below.

$$M = \frac{w^2 p}{12} \tag{5}$$

Further, assuming the thickness of the piezoelectric bodies 52 is $t_p$, the voltage applied to the piezoelectric bodies 52 is V, and the piezoelectric constant (transverse effect) is $d_{31}$, the stress $\sigma_p$ generated in the piezoelectric bodies 52 can be expressed as shown in expression (6) below.

$$\sigma_p = E\varepsilon_p = E \cdot \frac{d_{31} V}{t_P} \tag{6}$$

Moreover, because the bending moment M is the product of the section modulus z and the generated stress $\sigma_p$, it can be expressed as shown in expression (7) below.

$$M = z\sigma_p \tag{7}$$

When expression (6) is assigned to this expression (7), it can be expressed as shown in expression (8) below.

$$M = z\sigma_P = \frac{E d_{31} V t^2}{6 t_P} \tag{8}$$

When expression (8) is assigned to expression (5) and transformed to an expression in regard to the uniformly-distributed weight p, then the uniformly-distributed weight p can be expressed as shown in expression (9) below.

$$p = \frac{2 E d_{31} V t^2}{w^2 t_P} \tag{9}$$

Next, based on the above result, the energy J is determined. The energy J can be expressed as shown in expression (10) below, by the electrostatic capacitance $C_p$ of the piezoelectric bodies 52.

$$J = \frac{1}{2} C_p V^2 \tag{10}$$

Assuming the relative permittivity of the piezoelectric bodies 52 is $\epsilon$, and the vacuum permittivity is $\epsilon_0$($\epsilon_0$=8.854×10$^{-12}$ [F/m]), the electrostatic capacitance $C_p$ can be expressed as shown in expression (11) below.

$$C_p = \frac{w l \varepsilon \varepsilon_0}{t_P} \tag{11}$$

Further, when expression (9) is assigned to expression (4) and transformed to an expression in regard to V, the drive voltage V can be expressed as shown in expression (12) below.

$$V = \frac{30 \Delta Q t t_P}{(1 - \upsilon^2) d_{31} w^3 l} \tag{12}$$

Additionally, when expression (11) and expression (12) are assigned to expression (10), then expression (1) is derived.

$$J = \frac{30^2 \Delta Q^2}{(1 - \upsilon^2)} \cdot \frac{\varepsilon \varepsilon_0}{d_{31}^2} \cdot \frac{t^2 t_p}{w^5 l} \tag{1}$$

In this expression (1), the second term is determined by the physical value of the piezoelectric body material of the piezoelectric bodies 52, and the third term is determined by the shape of the piezoelectric bodies 52.

As will be understood from this expression (1), in order to reduce the energy J for obtaining the necessary excluded volume ΔQ, it suffices to reduce the second term. For that reason, it is preferred to reduce the value obtained by dividing the relative permittivity $\epsilon$ of the piezoelectric bodies 52 by the square of the piezoelectric constant $d_{31}$ of the piezoelectric transverse effect.

Figure 8:
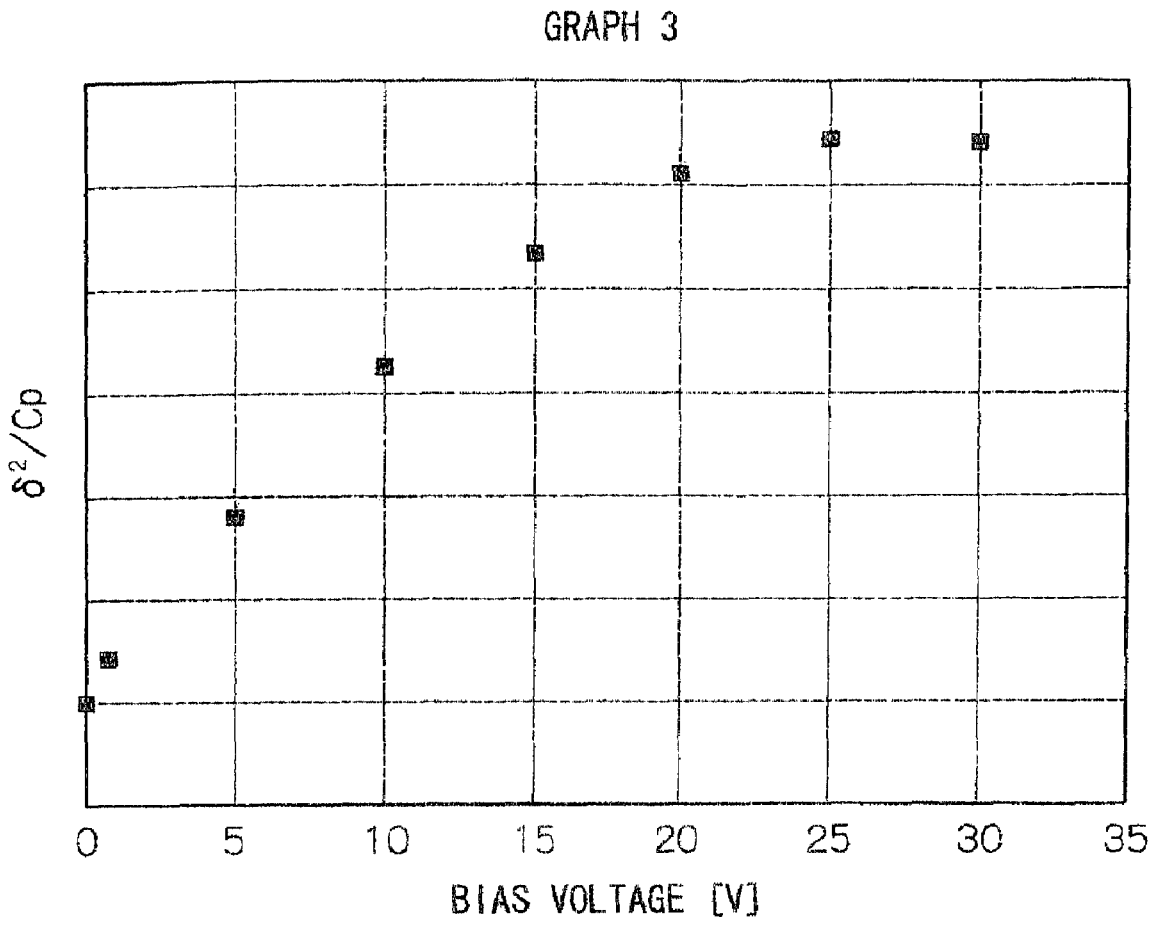
FIG. 8 is a graph showing the relationship between the bias voltage and a value obtained by dividing the square of the deformation amount by the electrostatic capacitance.

Graph 3 of FIG. 8 shows the relationship between the bias voltage and a value obtained by dividing the square of the deformation amount δ by the electrostatic capacitance ($\delta^2/C_p$), using the results of Graph 1 shown in FIG. 4 and Graph 2 shown in FIG. 6.

Here, the deformation amount δ is proportional to the piezoelectric constant $d_{31}$ ($\delta \propto D_{31}$), and the electrostatic capacitance $C_p$ is proportional to the relative permittivity ($C_p \propto \epsilon$). For this reason, as shown in expression (1), the vertical axis of Graph 3 in FIG. 8 becomes correlated to the size of the energy J for obtaining the same excluded volume ΔQ. In the case of Graph 3 in FIG. 8, it becomes a maximum value at 25 V. In this case, efficiency becomes best because the second term in expression (1) becomes smallest.

Figure 9:
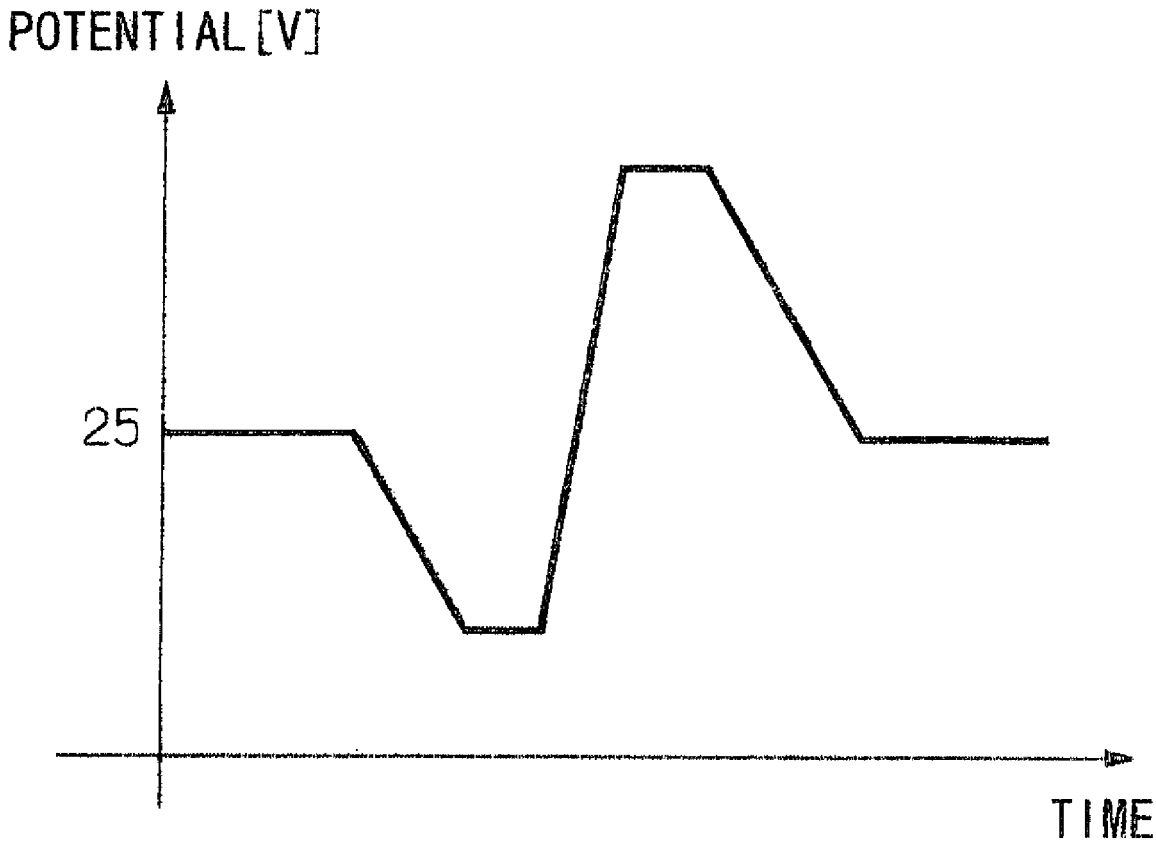
FIG. 9 is a waveform diagram showing an example of a drive waveform of a drive voltage generated by a drive voltage generating circuit according to an exemplary embodiment.

FIG. 9 shows an example of a drive waveform of a drive voltage generated by the drive voltage generating circuit 56 according to the present exemplary embodiment.

The drive voltage generating circuit 56, according to the present exemplary embodiment, uses 25 V for the bias voltage and generates a drive voltage where a voltage of a drive waveform predetermined in response to the droplet amount of the ink to be ejected is superposed on this bias voltage.

It will be noted that the drive voltage generating circuit 56 according to the present exemplary embodiment uses 25V, whose value is the maximum value in Graph 3, as the bias voltage. However, the drive voltage generating circuit 56 may also use a voltage level whose value is the maximum level in Graph 3 as a reference voltage level, and generate a drive voltage where a voltage of a predetermined drive waveform is superposed on the bias voltage of the voltage level of a predetermined range including this reference voltage level. This predetermined range may be appropriately determined in accordance with the characteristics of the piezoelectric bodies 52 and the configuration of the liquid droplet ejecting head 20. Specifically, it is preferred that it be within ±50% using the reference voltage level as a reference, and more preferred that it be within ±30% using the reference voltage level as a reference.

Figure 10:
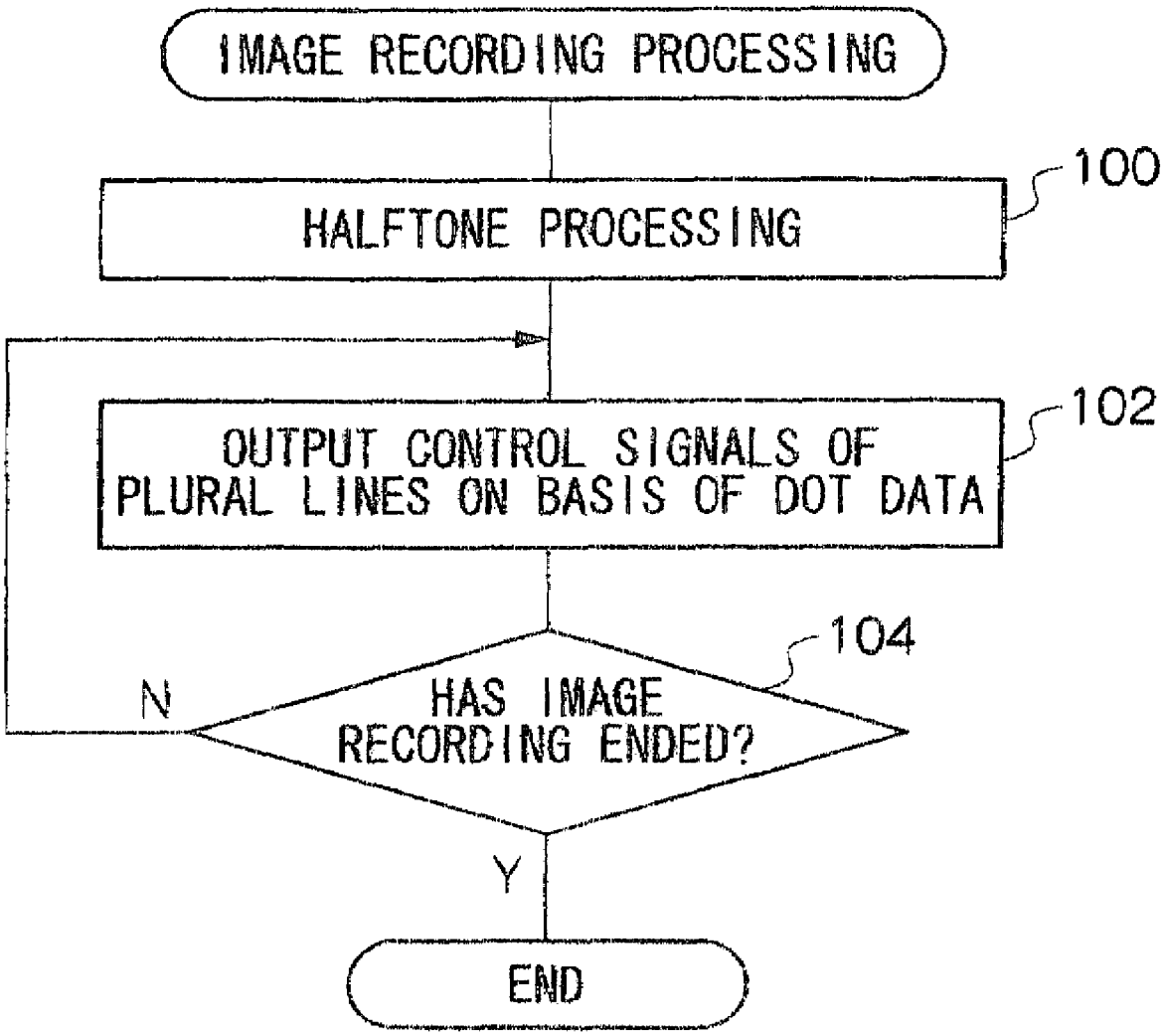
FIG. 10 is a flowchart showing the flow of image recording processing according to an exemplary embodiment.

Next, the action of the printer 10 when image data are inputted from an external device (not shown) will be described with reference to FIG. 10. FIG. 10 is a flowchart showing the flow of image recording processing that is executed by the controller 12 when image data are inputted from an external device (not shown).

In step 100, the controller 12 performs various kinds of image processing such as halftone processing with respect to the image data that have been inputted from the external device (not shown) and creates dot data per dot configuring pixels.

In step 102, the controller 12 outputs, to the drive control circuit 16, control signals of plural lines in which ejection/non-ejection of liquid droplets of each nozzle of the liquid droplet ejecting head 20 on the basis of the dot data that have been created.

The drive circuit 16 generates a drive voltage of a drive waveform such as shown in FIG. 9 in the drive voltage generating circuit 56. Next, when the control signals are inputted from the controller 12 via plural lines, the drive control circuit 16 switches each internal switch circuit 54 ON or OFF in response to the control signals. Thus, the drive voltage supplied from the drive voltage generating circuit 56 is applied to the piezoelectric bodies 52 connected to the switch circuits that have been switched ON.

The piezoelectric bodies 52, to which the drive voltage has been applied, cause a volume change inside the pressure chambers 46, as a result of being deformed in response to the drive waveform of the drive voltage that has been applied, and cause liquid droplets to be ejected from the nozzles as a result of causing vibrational waves inside the pressure chambers 46.

In step 104 that follows, the controller 12 determines whether or not recording of the image represented by the dot data that have been created has ended. When the determination is NO, then the controller 12 returns to step 102 and continues image recording based on the dot data. When the determination is YES, then image recording processing ends.

Figure 11:
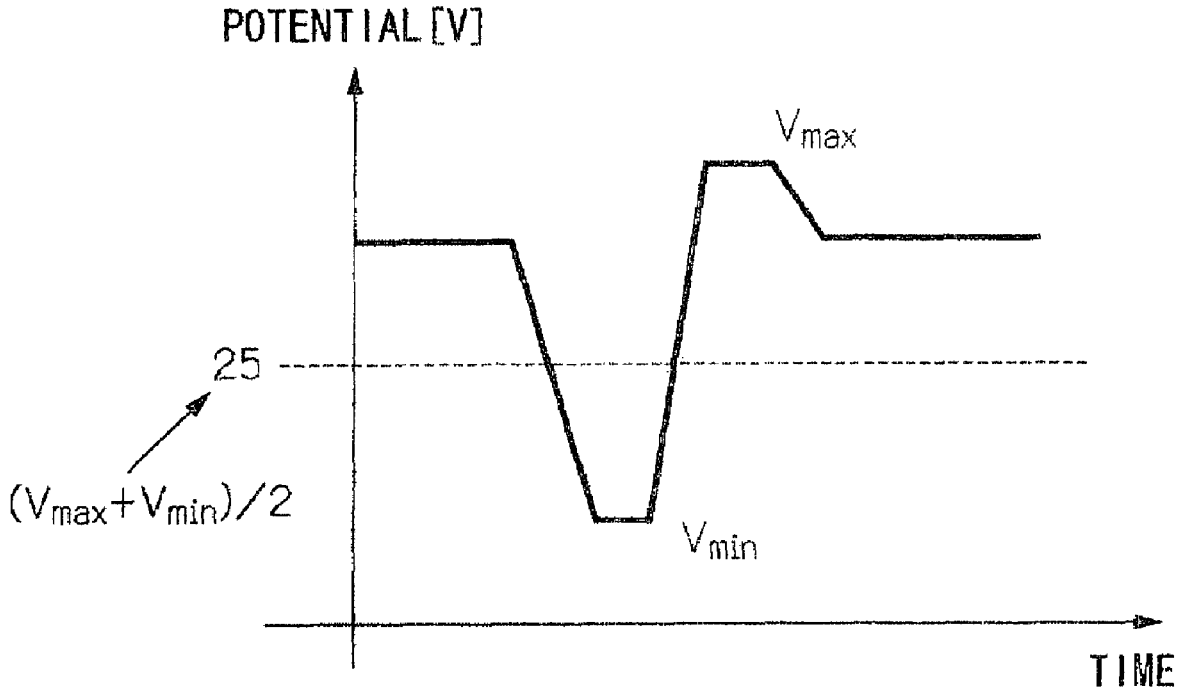
FIG. 11 is a waveform diagram showing another example of a drive waveform of a drive voltage generated by the drive voltage generating circuit according to an exemplary embodiment.

It will be noted that, in the present exemplary embodiment, a case has been described where the drive voltage generating circuit 56 generates a voltage where a voltage of a predetermined drive waveform is superposed on a bias voltage of a voltage level of a predetermined range including a reference voltage level as a drive voltage. However, the present invention is not limited to this. For example, as shown in FIG. 11, the invention may also be configured such that the drive voltage generating circuit 56 generates, and applies to the piezoelectric bodies 52, a drive voltage of a drive waveform where the average of each voltage level of a maximum voltage $V_{max}$ and a minimum voltage $V_{min}$ is in a range predetermined from the reference voltage level (in FIG. 11, the average of $V_{max}$ and $V_{min}$ is 25 V). This predetermined range may be appropriately determined in accordance with the characteristics of the piezoelectric bodies 52 and the configuration of the liquid droplet ejecting head 20.

Further, in the present exemplary embodiment, a case has been described where the unimorph-type liquid droplet ejecting head 20 (see FIG. 2), that is widely used in inkjet printers, is used. However, the present invention is not limited to this. For example, as shown in FIG. 12, the present invention may also be applied to a Push-type liquid droplet ejecting head, which is widely used in inkjet printers, and where the diaphragm 46A is pushed by plurally layered piezoelectric bodies 52.

Figure 12:
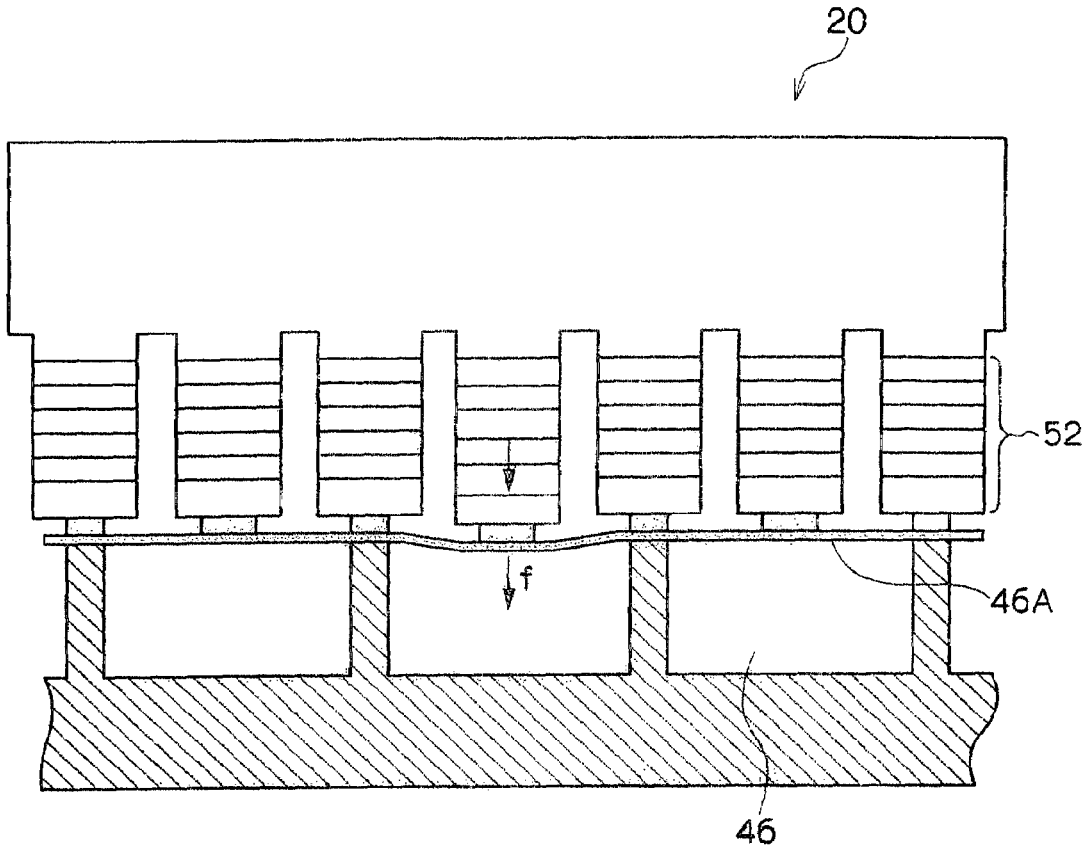
FIG. 12 is a diagram showing the general configuration of a Push-type liquid droplet ejecting head according to an exemplary embodiment.
Figure 13:
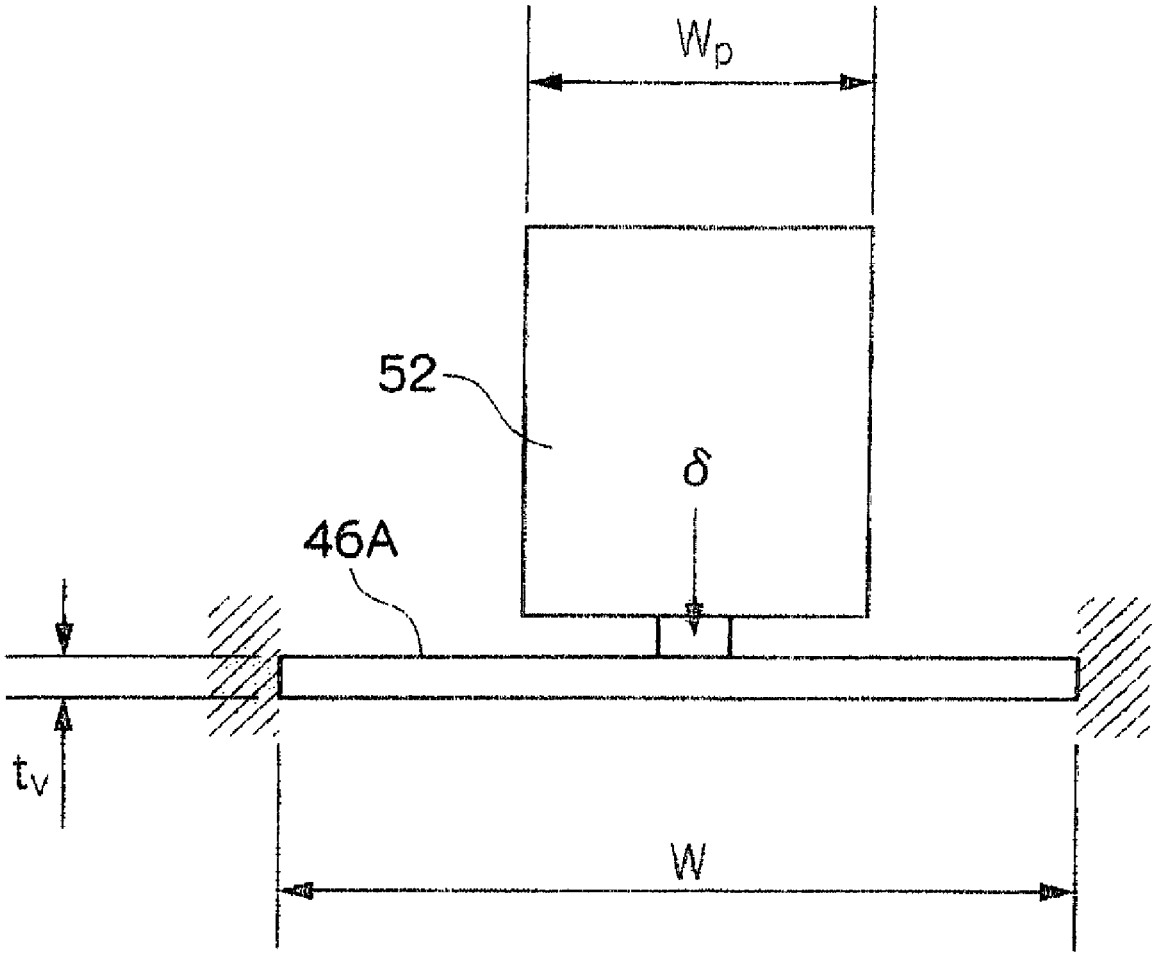
FIG. 13 is a diagram where a piezoelectric body of the Push-type liquid droplet ejecting head according to an exemplary embodiment is modeled.

FIG. 13 is a diagram where the Push-type liquid droplet ejecting head shown in FIG. 12 is modeled.

Here given that:

$w_p$: width of piezoelectric body $t_v$: thickness of diaphragm w: width of diaphragm l: length of diaphragm (depth direction in the drawing)

$d_{33}$: piezoelectric constant (longitudinal effect)

the energy in this Push-type liquid droplet ejecting head is proportional to a value obtained by dividing the permittivity (∝ electrostatic capacitance) of the piezoelectric bodies by the square of the piezoelectric constant ($d_{33}$) of the piezoelectric longitudinal effect, as shown in expression (13) below.

$$J \propto \frac{\varepsilon\varepsilon_0}{d_{33}^2} \tag{13}$$

Further, when the piezoelectric transverse effect is used in the deformation of the diaphragm in the Push-type liquid droplet ejecting head, $d_{33}$ in expression (13) is changed to $d_{31}$.

As will be understood from this expression (13), even in the Push-type liquid droplet ejecting head, the same drive method as that of the unimorph-type liquid droplet ejecting head 20 can be used.

Figure 14:
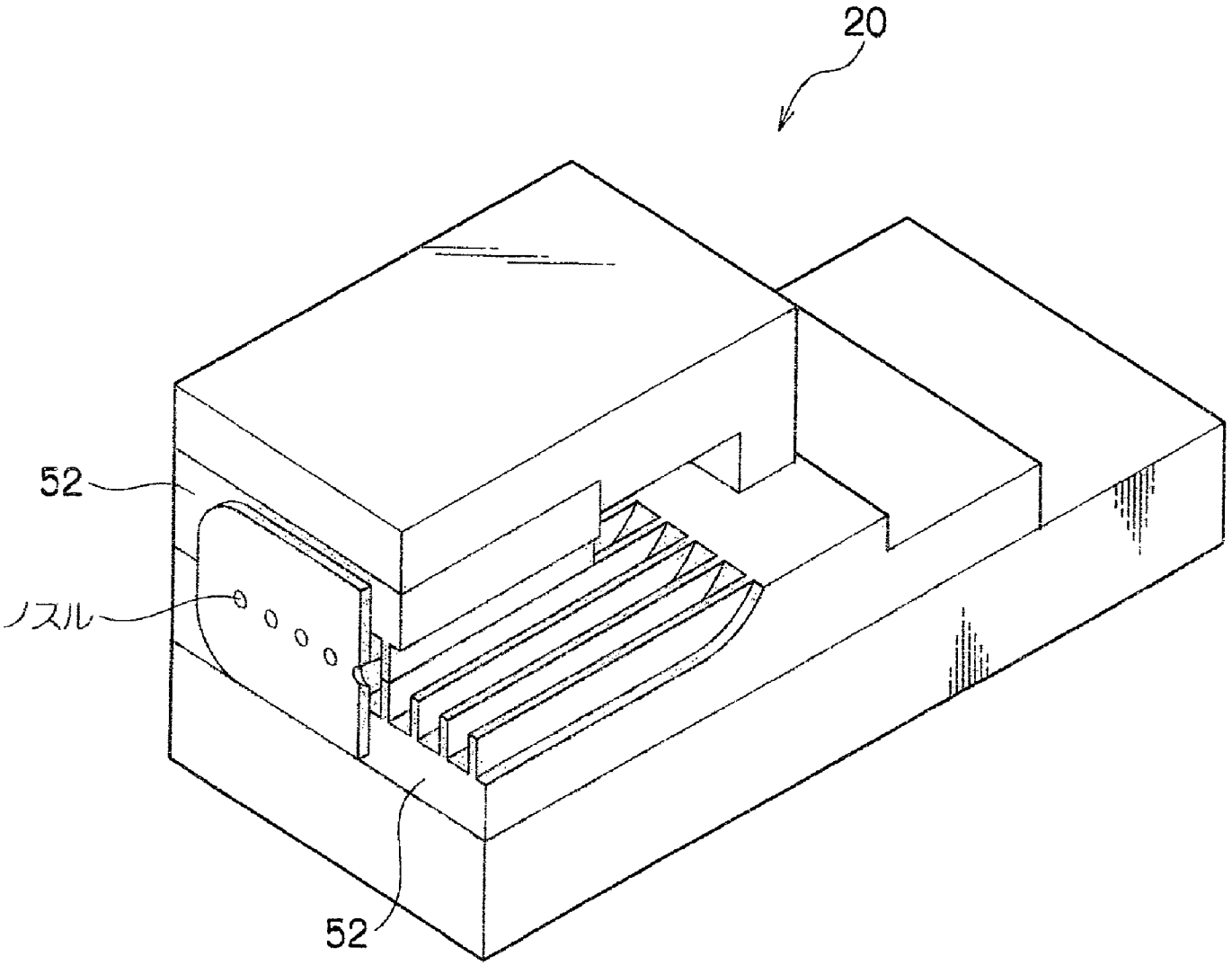
FIG. 14 is a diagram showing the general configuration of a Wall-type liquid droplet ejecting head according to an exemplary embodiment.

Moreover, as shown in FIG. 14, the present invention may also be applied to a Wall-type liquid droplet ejecting head that are widely used in inkjet printers. In the Wall-type liquid droplet ejecting head, the walls of the pressure chambers 46 are formed by the piezoelectric bodies 52, and the piezoelectric bodies 52 are caused to deform, whereby a volume change inside the pressure chambers 46 is generated.

Figure 15:
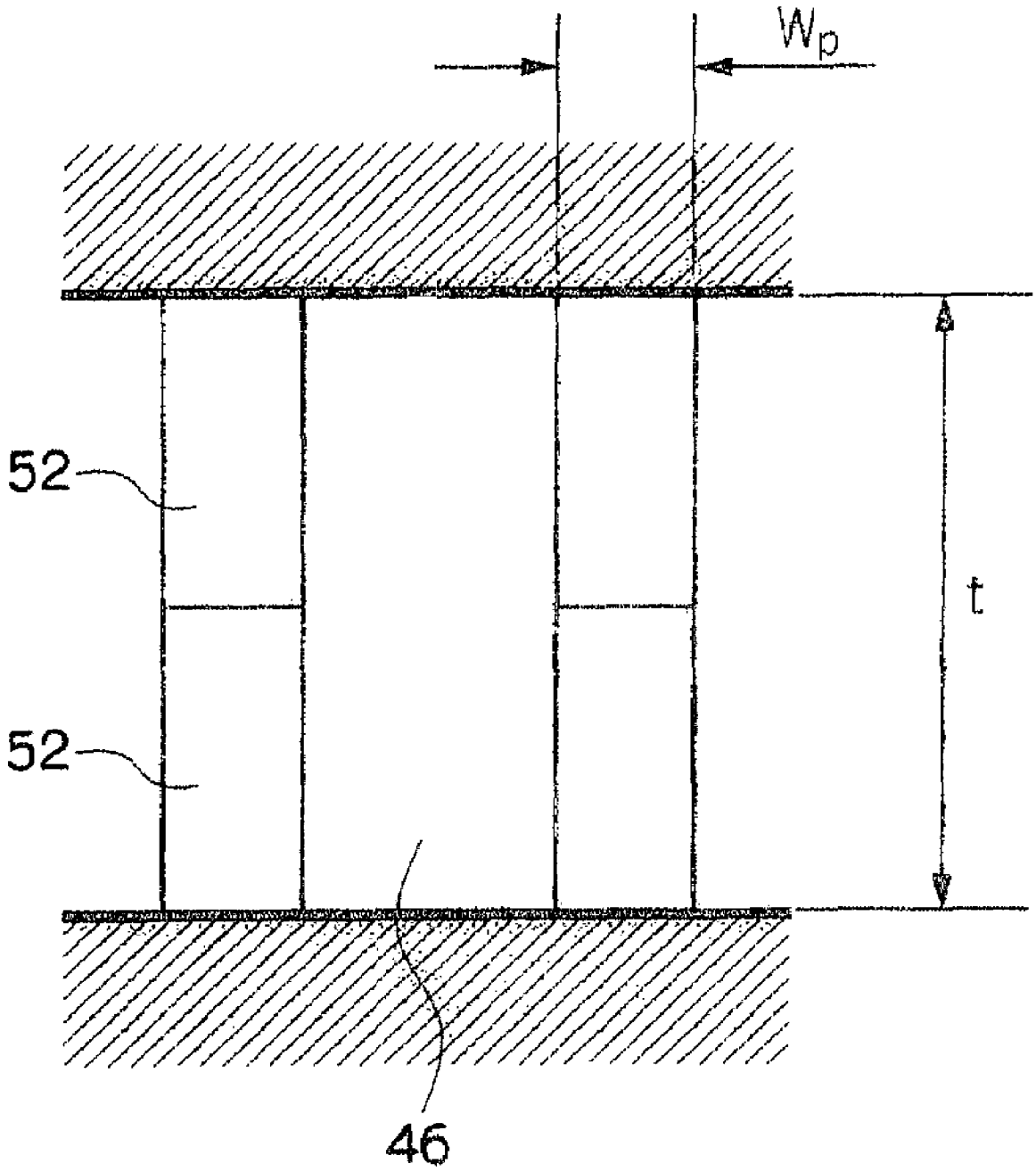
FIG. 15 is a diagram where a piezoelectric body of the Wall-type liquid droplet ejecting head according to an exemplary embodiment is modeled.

FIG. 15 is a diagram where the Wall-type liquid droplet ejecting bead shown in FIG. 14 is modeled.

Here given that:

$w_p$: width of piezoelectric body t: height of pressure chamber l: length of pressure chamber (depth direction in the drawing)

$d_{15}$: piezoelectric constant the energy in the Wall-type liquid droplet ejecting head is proportional to a value obtained by dividing the permittivity (∝ electrostatic capacitance) of the piezoelectric bodies by the square of the piezoelectric constant ($d_{15}$) of the piezoelectric shear effect, as shown in expression (14) below.

$$J \propto \frac{\varepsilon\varepsilon_0}{d_{15}^2} \tag{14}$$

Further, when the piezoelectric transverse effect or longitudinal effect is used in the deformation in the Wall-type liquid droplet ejecting head, $d_{15}$ in expression (14) is changed to $d_{31}$ or $d_{33}$.

As will be understood from this expression (14), even in the Wall-type liquid droplet ejecting head, the same drive method as that of the unimorph-type liquid droplet ejecting head 20 can be used.

Further, in the present exemplary embodiment, a case has been described where there was one type of drive wave form generated in the drive voltage generating circuit 56. However, the present invention is not limited to this. For example, the invention may also be configured such that the drive control circuit 16 generates, in the drive voltage generating circuit 56, drive voltages 1 to 3 whose drive waveform have been determined beforehand such that the retention times during which the volumes of the pressure chambers 46 are maintained in a contracted state are changed and the amounts of the liquid droplets to be ejected become three types that are different (e.g., large droplets, middle-sized droplets, and small droplets) and is made capable of selectively applying the drive voltages 1 to 3 to each of the piezoelectric bodies 52 in response to the control signals of plural lines inputted from the controller 12 and such that the controller 12 outputs control signals corresponding to the densities of the dots to be recorded to thereby change the amounts of the liquid droplets to be ejected from the nozzles.

Further, the present invention may also be applied to a printer 10 that records an image with respect to recording paper while causing the liquid droplet ejecting head 20 to reciprocally move in a main scanning direction. Further, the present invention may also be applied to a printer 10 where the liquid droplet ejecting head 20 is configured as a long head that is wider than the width of the recording paper, and where numerous nozzles are arranged along the width direction of the recording paper, with the printer 10 ejecting liquid droplets from each of the nozzles of the liquid droplet ejecting head 20 while causing the recording paper to relatively move in a sub-scanning direction to thereby record the entire width of the recording paper at once.

In addition, the configuration of the printer 10 described in the present exemplary embodiment (see FIG. 1) and the configuration of the liquid droplet ejecting head 20 (see FIG. 2, FIG. 12 and FIG. 14) are one example and are appropriately alterable within a range that does not depart from the gist of the invention.

Further, the deformation amount with respect to the change in the bias voltage of the piezoelectric bodies described in the present exemplary embodiment, the characteristics of the electrostatic capacitance (see FIG. 4 and FIG. 6), and the drive waveforms (see FIG. 9 and FIG. 11) are also one example.

Further, the image recording processing (see FIG. 10) described in the present exemplary embodiment is also one example and is approximately alterable within a range that does not depart from the gist of the present invention.

Further, the printer 10 described in the present exemplary embodiment recorded an image (including characters) on a recording medium. However, the printer 10 of the present invention is not limited to this. Further, the liquid to be ejected is not limited to ink. For example, the present invention can also be applied to other liquid droplet ejecting and recording apparatus, such as pattern forming apparatus that eject liquid droplets onto a sheet-like substrate in order to form a pattern such as in semiconductors and liquid crystal displays.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting apparatus comprising:

a piezoelectric body that deforms and ejects liquid droplets as a result of a voltage being applied to the piezoelectric body and, when a superposed voltage, obtained by superposing a constant voltage of a constant voltage level and a waveform voltage of a sinusoidal waveform, is applied to the piezoelectric body, at least one of an electrostatic capacitance and a deformation amount of the piezoelectric body changes in response to the voltage level of the constant voltage; and a voltage applying unit that uses, as a reference voltage level, the voltage level of the constant voltage when the square of the deformation amount of the piezoelectric body divided by the electrostatic capacitance is at a maximum value, and that applies to the piezoelectric body, when the piezoelectric body ejects the liquid droplets, a drive voltage obtained by superposing a voltage of a predetermined drive waveform on the constant voltage that is within a predetermined range that includes the reference voltage level.

2. The liquid droplet ejecting apparatus of claim 1, wherein the piezoelectric body includes a relaxer material whose main component is lead zirconate titanate.

3. A liquid droplet ejecting apparatus comprising:

a piezoelectric body that deforms and ejects liquid droplets as a result of a voltage being applied to the piezoelectric body and, when a superposed voltage, obtained by superposing a constant voltage of a constant voltage level and a waveform voltage of a sinusoidal waveform, is applied to the piezoelectric body, at least one of an electrostatic capacitance and a deformation amount of the piezoelectric body changes in response to the voltage level of the constant voltage; and a voltage applying unit that uses, as a reference voltage level, the voltage level of the constant voltage when the square of the deformation amount of the piezoelectric body divided by the electrostatic capacitance is at a maximum value, and that applies to the piezoelectric body, when the piezoelectric body ejects the liquid droplets, a drive voltage having a drive waveform in which the average of a maximum voltage and a minimum voltage is within a predetermined range from the reference voltage level.

4. The liquid droplet ejecting apparatus of claim 3, wherein the piezoelectric body includes a relaxer material whose main component is lead zirconate titanate.

5. A liquid droplet ejecting method comprising:

in a piezoelectric body where, when a superposed voltage, obtained by superposing a constant voltage of a constant voltage level and a waveform voltage of a sinusoidal waveform, is applied to the piezoelectric body, at least one of an electrostatic capacitance and a deformation amount of the piezoelectric body changes in response to the voltage level of the constant voltage, using, as a reference voltage level, the voltage level of the constant voltage when the square of the deformation amount of the piezoelectric body divided by the electrostatic capacitance is at a maximum value, and applying, to the piezoelectric body, a drive voltage obtained by superposing a voltage of a predetermined drive waveform on the constant voltage that is within a predetermined range that includes the reference voltage level; and applying the drive voltage such that the piezoelectric body deforms and ejects liquid droplets.

6. The liquid droplet ejecting method of claim 5, wherein the piezoelectric body includes a relaxer material whose main component is lead zirconate titanate.

7. A liquid droplet ejecting method comprising:

in a piezoelectric body where, when a superposed voltage, obtained by superposing a constant voltage of a constant voltage level and a waveform voltage of a sinusoidal waveform, is applied to the piezoelectric body, at least one of an electrostatic capacitance and a deformation amount of the piezoelectric body changes in response to the voltage level of the constant voltage, using, as a reference voltage level, the voltage level of the constant voltage when the square of the deformation amount of the piezoelectric body divided by the electrostatic capacitance is at a maximum value, and applying, to the piezoelectric body, a drive voltage having a drive waveform in which the average of each of a maximum voltage and a minimum voltage is in a predetermined range from the reference voltage level; and applying the drive voltage such that the piezoelectric body deforms and ejects liquid droplets.

8. The liquid droplet ejecting method of claim 7, wherein the piezoelectric body includes a relaxer material whose main component is lead zirconate titanate.

9. A liquid droplet ejecting head comprising:

the liquid droplet ejecting apparatus of claim 1;

a diaphragm that is connected to the piezoelectric body and that vibrates together with the deformation of the piezoelectric body;

a pressure chamber that is filled with ink and that is a space that includes the diaphragm and plural walls; and a nozzle that ejects the ink in response to a change in volume of the pressure chamber due to the vibration of the diaphragm.

10. A liquid droplet ejecting head comprising:

the liquid droplet ejecting apparatus of claim 3;

a diaphragm that is connected to the piezoelectric body and that vibrates together with the deformation of the piezoelectric body;

a pressure chamber that is filled with ink and that is a space that includes the diaphragm and plural walls; and a nozzle that ejects the ink in response to a change in volume of the pressure chamber due to the vibration of the diaphragm.

* * * * *